US005889455A

United States Patent [19]

Sakamoto

[11] Patent Number: 5,889,455

[45] Date of Patent: Mar. 30, 1999

[54] ELECTROMAGNET IN WHICH A COIL MEMBER IS INCLINED IN AN ANNULAR GROOVE OF A CORE

[75] Inventor: Yuki Sakamoto, Isesaki, Japan

[73] Assignee: Sanden Corporation, Gunma, Japan

[21] Appl. No.: 943,740

[22] Filed: Oct. 3, 1997

[30] Foreign Application Priority Data

Oct. 7, 1996 [JP] Japan ..... 8-266127

[51] Int. Cl.[6] ..... H01F 7/20

[52] U.S. Cl. ..... 335/289; 335/248; 335/250; 335/296

[58] Field of Search ..... 335/289, 248, 335/250, 296

[56] References Cited

U.S. PATENT DOCUMENTS

| | | | |
|---|---|---|---|
| 3,130,355 | 4/1964 | Younger . | |
| 3,585,450 | 6/1971 | Lane . | |
| 4,181,393 | 1/1980 | Lill . | |
| 4,404,534 | 9/1983 | Janvrin . | |
| 4,419,536 | 12/1983 | Doyle et al. . | |
| 4,429,358 | 1/1984 | Miyagi . | |
| 4,432,446 | 2/1984 | Okano et al. . | |
| 4,503,413 | 3/1985 | Stalzer . | |
| 4,547,757 | 10/1985 | Yamada | 335/296 |
| 4,557,544 | 12/1985 | Esser . | |
| 4,623,754 | 11/1986 | Kikuchi et al. . | |
| 4,771,198 | 9/1988 | Aschberger et al. . | |
| 4,779,578 | 10/1988 | Matsushita . | |
| 4,935,713 | 6/1990 | Bekheet . | |
| 5,121,093 | 6/1992 | Matsushita | 335/296 |
| 5,138,293 | 8/1992 | Ishimaru . | |
| 5,225,801 | 7/1993 | Ida et al. . | |
| 5,307,038 | 4/1994 | Ishimaru | 335/296 |
| 5,320,206 | 6/1994 | Maejima . | |
| 5,508,671 | 4/1996 | Takashi . | |

FOREIGN PATENT DOCUMENTS

| | | |
|---|---|---|
| 0422962 | 4/1991 | European Pat. Off. . |
| 2726400 | 10/1995 | France . |
| 3816965 | 11/1989 | Germany . |
| 56138529 | 10/1981 | Japan . |
| 2106007 | 4/1990 | Japan . |
| 2253014 | 11/1990 | Japan . |
| 8247171 | 9/1996 | Japan . |
| 917200 | 1/1963 | United Kingdom . |
| 2234329 | 1/1991 | United Kingdom . |
| 2248969 | 4/1992 | United Kingdom . |

*Primary Examiner*—Michael L. Gellner
*Assistant Examiner*—Tuyen T. Nguyen
*Attorney, Agent, or Firm*—Baker & Botts, L.L.P.

[57] ABSTRACT

In an electromagnet (1) in which a lead wire (21*a*) is extracted through a through hole (33) from an annular coil member (2) placed in an annular groove (32) of an annular core (3), a spacer (5) is provided to make the annular coil member have a first portion spaced from the through hole in an axial direction of the annular core. The through hole is formed to a closed bottom surface of the annular groove. A thermal fuse (4) is located at a second portion of the annular coil member on a surface facing opposite to the closed bottom surface of the annular groove. The electromagnet is for use in an electromagnetic clutch.

9 Claims, 2 Drawing Sheets

ELECTROMAGNET IN WHICH A COIL MEMBER IS INCLINED IN AN ANNULAR GROOVE OF A CORE

BACKGROUND OF THE INVENTION

This invention relates to an electromagnet for use in an electromagnetic clutch known in the art.

A conventional electromagnet for use in the electromagnetic clutch comprises an annular core with an annular groove, an annular coil member placed in the annular groove, and a thermal fuse attached to the annular coil member.

The annular groove has an opening surface and a closed bottom surface which are opposite to each other in an axial direction of the annular core. The annular coil member has a first surface facing the closed bottom surface and has a second surface opposite to the first surface in an axial direction of the annular coil member. The thermal fuse is placed on the second surface of the annular coil member.

The annular core further has a through hole at a particular portion of the closed bottom surface. The annular coil member further has two lead wires which are extracted outwards from the annular groove through the through hole.

In the conventional electromagnet, the annular coil member has a center line coaxial with that of the annular core. As a result, an overall area of the first surface of the annular coil member is kept in contact with the closed bottom surface of the annular groove.

With this structure, the lead wires are led into the through hole through an area which is between the first surface of the annular coil member and the closed bottom surface of the annular groove. Thus, the lead wires can possibly be brought into tight contact with the annular core to thereby damage or break the electrical insulation of the annular coil member.

In order to remove the possibility of occurrence of damage, a spacer having a sufficient size is arranged between the annular coil member and the annular core throughout the overall area of the closed bottom surface of the annular groove. In this case, however, the thermal fuse may possibly protrude from the annular groove to be brought into contact with a pulley of the electromagnetic clutch in the manner known in the art.

SUMMARY OF THE INVENTION

It is therefore an object of this invention to provide an electromagnet for an electromagnetic clutch, which is capable of inhibiting lead wires of an annular coil member from being brought into tight contact with an annular core.

It is another object of this invention to provide an electromagnet of the type described, which is capable of inhibiting a thermal fuse from being brought into contact with a pulley of the electromagnetic clutch.

Other objects of this invention will become clear as the description proceeds.

According to an aspect of this invention, there is provided an electromagnet for use in an electromagnetic clutch. The electromagnet comprises an annular core with an annular groove having an opening surface and a closed bottom surface opposite to each other in an axial direction of the annular core, an annular coil member placed in the annular groove and having a first surface facing the closed bottom surface and a second surface opposite to the first surface in an axial direction of the annular coil member, and a thermal fuse placed on the second surface. The annular core has a through hole at a particular portion of the closed bottom surface. The annular coil member has lead wires at least one of which is extracted outwards from the annular groove through the through hole. The electromagnet further comprises spacing means mated with the annular core and the annular coil member for making the annular coil member have a first portion spaced from the particular portion in the axial direction of the annular core. The thermal fuse is located at a second portion of the annular coil member.

DESCRIPTION OF THE PREFERRED EMBODIMENT

Now, description will be made about an electromagnet according to an embodiment of this invention with reference to the drawings.

Figure 1:
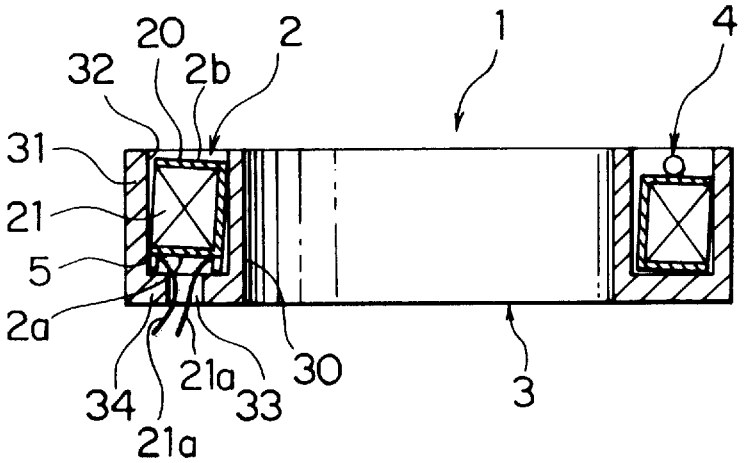
FIG. 1 is a vertical sectional view of an Electromagnet according to an embodiment of this invention.

Referring to FIG. 1, the electromagnet is designated by a reference numeral 1 and is for use in an electromagnetic clutch known in the art. In the manner which will presently be described, the electromagnet 1 comprises a coil member 2, a core 3, and a thermal fuse 4. The coil member 2 has an annular shape and comprises a bobbin 20 and a winding 21 wound around the bobbin 20.

Figure 2A:
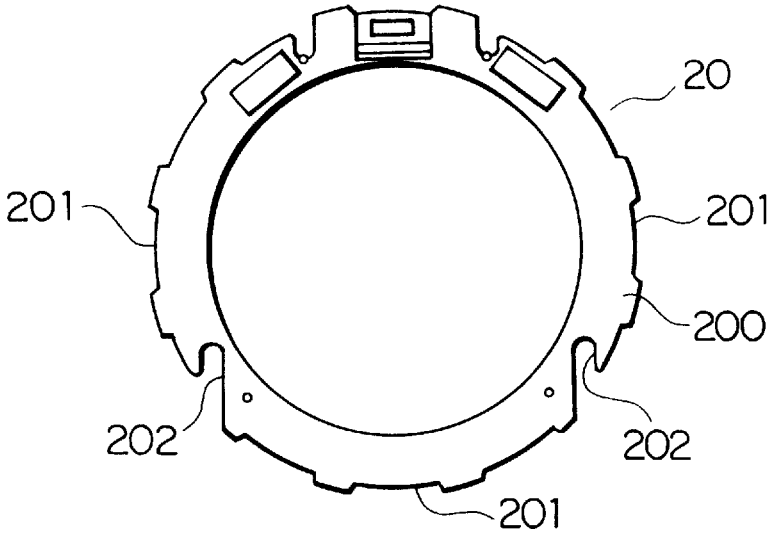
FIGS. 2A, 2B, and 2C are a front view, a cross-sectional view, and a bottom view of a bobbin used in the electromagnet in FIG. 1.
Figure 2B:
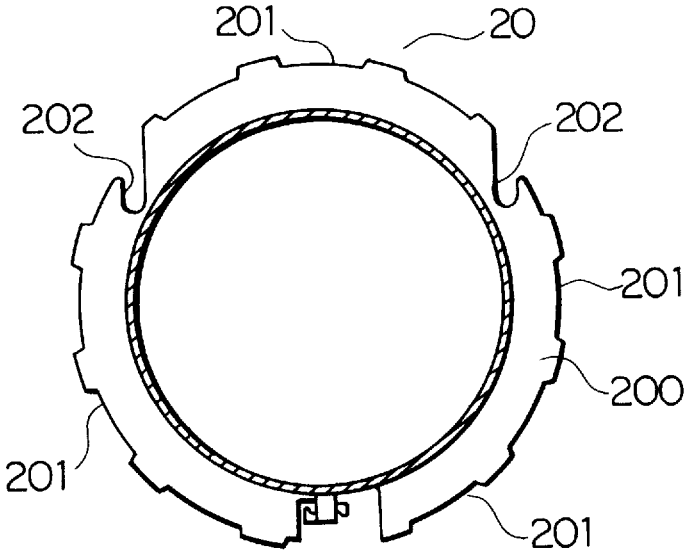
Figure 2C:
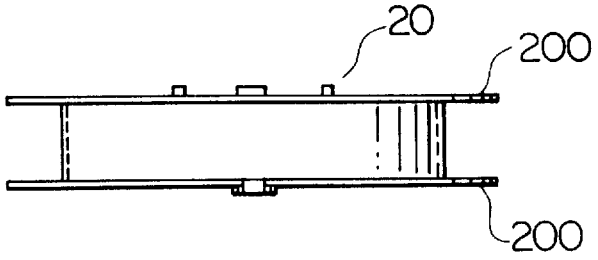

Referring to FIGS. 2A, 2B, and 2C shortly, the description will be directed to the bobbin 20. The bobbin 20 has a flange portion 200 with a plurality of shallow notches 201 formed at its outer peripheral edge so as to easily and reliably fill the resin (not shown) into an annular groove 32 (which will later be described in detail) by potting known in the art. The flange portion 200 of the bobbin 20 is further provided with a plurality of deep grooves 202 for preventing deformation of the bobbin 20 during molding.

Returning back to FIG. 1, the core 3 also has an annular shape and comprises a cylindrical core body 30, a generally cylindrical yoke portion 31 concentric with the cylindrical core body 30 with a space left therebetween, and a plate-shaped yoke portion 34 formed integral with the cylindrical core body 30 and the cylindrical yoke portion 31. A combination of the yoke portions 31 and 34 serves to create a magnetic path at the outside of the core body 30. The cylindrical core body 30, the cylindrical yoke portion 31, and the plate-shaped yoke portion 34 will be referred to as an inner cylindrical portion, an outer cylindrical portion, and a ring plate portion, respectively.

The annular groove 32 is formed between the core body 30 and the yoke portion 31 to have an opening surface and a closed bottom surface opposite to each other in an axial direction of the core 3. The coil member 2 is placed in the annular groove 32 and has a first surface 2*a* facing the closed bottom surface or the plate-shaped yoke portion 34 and a second surface 2*b* opposite to the first surface in an axial direction of the coil member 2.

The plate-shaped yoke portion 34 closes the above-mentioned space at one of ends thereof in the axial direction of the core 3 to define the closed bottom surface of the annular groove 32. The plate-shaped yoke portion 34 has a through hole or an outlet 33 at a particular portion thereof. The outlet 33 serves to extract, outwards from the annular groove 32, at least one of lead wires 21*a* of the winding 21 of the coil member 2 that is received in the annular groove 32.

The coil member 2 has a first portion adjacent to the outlet 33 in the axial direction of the core 3 and a second portion opposite to the first portion in a radial direction of the core 3. The thermal fuse 4 is known in the art and is located at the second portion of the coil member 2 on the second surface 2*b* thereof. Specifically, the thermal fuse 4 is offset substantially by 180° from the outlet 33 with respect to the center of the core 3. The thermal fuse 4 is connected in cascade to one of the lead wires 21*a* of the winding 21 in the manner known in the art.

The electromagnet 1 further comprises a spacer 5 placed in the vicinity of the outlet 33 in the annular groove 32. The spacer 5 is inserted between the coil member 2 and the closed bottom surface or the plate-shaped yoke portion 34 and is for making the first portion of the coil member 2 be spaced from the particular portion of the plate-shaped yoke portion 34. The spacer 5 is referred to as a spacing arrangement.

More particularly, the spacer 5 has a generally ring shape and surrounds the periphery of the outlet 33. The spacer 5 serves to keep the first portion of the coil member 2 be lifted or floated above the closed bottom surface of the annular groove 32. The second portion of the coil member 2 is brought into contact with the closed bottom surface of the annular groove 32. Thus, the coil member 2 is inclined within the annular groove 32. As a result, the leading wires 21*a* of the winding 21 can be extracted through the outlet 33 outwards from the annular groove 32 without being brought into contact with the core 3.

Since the coil member 2 is inclined in the annular groove 32 by presence of the spacer 5, the second portion of the coil member 2 which is provided with the thermal fuse 4 is lowered to be kept in contact with the closed bottom surface of the annular groove 32. As a result, the thermal fuse 4 also approaches towards the closed bottom surface of the annular groove 32 and, therefore, does not protrude from the annular groove 32. Thus, it is readily possible to prevent the thermal fuse 4 from being brought into contact with a pulley (not shown) of the electromagnetic clutch in the manner known in the art.

As described above, the annular groove 32 of the core 3 is filled with resin (not shown) by potting so as to fixedly hold the coil member 2 and the thermal fuse 4 within the annular groove 32.

While the present invention has thus been described in connection with a few embodiments thereof, it will readily be possible for those skilled in the art to put this invention into practice in various other manners. For example, the second portion of the coil member may be placed adjacent to the closed bottom surface of the annular groove without being brought into contact with the closed bottom surface. The thermal fuse may be displaced from the second portion of the coil member on the second surface thereof. The spacer may be formed integral with the bobbin.

What is claimed is:

1. An electromagnet for use in an electromagnetic clutch, which comprises an annular core with an annular groove having an opening surface and a closed bottom surface opposite to each other in an axial direction of said annular core, an annular coil member placed in said annular groove and having a first surface facing said closed bottom surface and a second surface opposite to said first surface in an axial direction of said annular coil member, and a thermal fuse placed on said second surface, said annular core having a through hole at a particular portion of said closed bottom surface, said annular coil member having lead wires at least one of which is extracted outwards from said annular groove through said through hole, said electromagnet further comprising spacing means mated with said annular core and said annular coil member for making said annular coil member have a first portion spaced from said particular portion in said axial direction of the annular core, said thermal fuse being located at a second portion of said annular coil member.

2. An electromagnet as claimed in claim 1, wherein said spacing means is placed between said annular coil member and said closed bottom surface in the vicinity of said through hole.

3. An electromagnet as claimed in claim 1, wherein said second portion is placed adjacent to said closed bottom surface.

4. An electromagnet as claimed in claim 1, wherein said second portion is brought into contact with said closed bottom surface.

5. An electromagnet as claimed in claim 1, wherein said first and said second portions are opposite to each other in said radial direction of the annular coil member.

6. An electromagnet as claimed in claim 1, further comprising resin filled in said annular groove by potting for fixedly holding said annular coil member and said thermal fuse within said annular groove.

7. An electromagnet as claimed in claim 1, wherein said annular coil member comprises:

a bobbin; and a winding wound around said bobbin and electrically connected to said lead wires and said thermal fuse.

8. An electromagnet as claimed in claim 7, wherein said spacing means is formed integral with said bobbin.

9. An electromagnet as claimed in claim 1, wherein said annular core comprises:

an inner cylindrical portion;

an outer cylindrical portion concentric with said inner cylindrical portion with a space left therebetween; and a ring plate portion formed integral with said inner and said outer cylindrical portions for closing said space at one of ends thereof in said axial direction of the annular core to define said closed bottom surface.

* * * * *